United States Patent [19]

Petty et al.

[11] Patent Number: 4,913,592

[45] Date of Patent: Apr. 3, 1990

[54] FLOATING STRUCTURE USING MECHANICAL BRAKING

[75] Inventors: Terry D. Petty, Kenner; William H. Rehmann, Jr., Slidell, both of La.

[73] Assignee: Odeco, Inc., New Orleans, La.

[21] Appl. No.: 314,747

[22] Filed: Feb. 24, 1989

[51] Int. Cl.[4] ..... E02B 17/00

[52] U.S. Cl. ..... 405/199; 405/195; 405/224; 166/355

[58] Field of Search ..... 405/195, 224, 199; 166/355; 188/67, 1–11, 38, 41, 43, 44

[56] References Cited

U.S. PATENT DOCUMENTS

| | | | |
|---|---|---|---|
| 3,396,945 | 8/1968 | Schreier et al. | 405/199 X |
| 4,167,147 | 9/1979 | Bergman | 114/122 |
| 4,215,950 | 8/1980 | Stevenson | 405/195 |
| 4,379,657 | 4/1983 | Widiner et al. | 405/303 X |
| 4,395,160 | 7/1983 | deJong | 405/195 |
| 4,449,854 | 5/1984 | Nayler | 166/355 X |
| 4,576,520 | 3/1986 | Suh et al. | 405/195 X |
| 4,617,998 | 10/1986 | Langner | 166/355 X |
| 4,626,136 | 12/1986 | Gunderson | 405/195 X |

*Primary Examiner*—Randolph A. Reese
*Assistant Examiner*—J. Russell McBee
*Attorney, Agent, or Firm*—Michael P. Breston

[57] ABSTRACT

The floating structure has a structural frame and a long member which has a lower end anchored to the seabed. The structural frame has limited heave motion relative to the long member. An extensible tensioner is between the frame and the long member. Mechanical brakes apply braking forces against the long member only when the floating structure heaves up. The brakes are inactive when the floating structure heaves down.

18 Claims, 2 Drawing Sheets

FLOATING STRUCTURE USING MECHANICAL BRAKING

BACKGROUND OF THE INVENTION

1. Field of the Invention

The present invention relates generally to heave stabilized floating structures and, more particularly, to floating platforms.

2. Description of the Prior Art

A floating structure, for example, a drilling/production platform, is effectively a spring mass system. As such, it has a resonant (natural) frequency and is subject to resonant oscillatory heave in response to wave and tidal action in the seaway. Resonant motion occurs when the natural period of heave is substantially equal to the period of the wave which induces such heave in the platform.

The patent literature describes various structures and arrangements for dynamically and passively damping a floating platform.

For example, the systems described by Bergman in U.S. Pat. No. 4,167,147, employ arrangements to create anti-heave forces that are in phase opposition and proportional to the heave velocity of the platform (Newtonian damping). These anti-heave forces are much smaller than the actual wave forces which produce the heave.

A platform can be designed so that its natural resonant period $T_n$ occurs at some given wave period $T_n$, and so as to experience a low resultant vertical force or heave in response to all waves with substantial energy in the design seaway. The design seaway will have a natural heave period $T_n$, which is greater than the longest period of the wave with substantial energy.

However, because determination of the worst expected or design seaway is based on historical records and statistics, a certain degree of uncertainty can be expected. Therefore, designers are always faced with a remote but real probability that the longest design wave period $T_n$ may be exceeded during the expected life of the floating platform.

Also, the platform's heave displacement is a particularly serious problem for rigid production risers which are suspended by mechanical tensioning devices having a fixed stroke range.

SUMMARY OF THE INVENTION

The floating structure comprises a structural framework and a long member which has a lower end anchored to the seabed. The structural framework has limited heave motion relative to the long member. An extensible tensioner is between the framework and the long member. The tensioner applies a predetermined tension to the long member. Mechanical brakes apply braking forces against the long member only when the structure heaves up, thereby selectively stopping or slowing the upward heave of the floating structure. The brakes are inactive when the structure heaves down.

In the preferred embodiment, the brakes are linear, hydraulically-activated, friction brakes. A brake cylinder is between the upper end of the long member and the tensioner. The brakes are on the framework and they apply frictional forces against the brake cylinder. The brake cylinder preferably has circumferentially-spaced fins on the outer surface thereof, and the brakes apply forces against the fins.

DESCRIPTION OF PREFERRED EMBODIMENTS

Many different types of floating semi-submersible structures are known and presently employed for hydrocarbon drilling and/or production, and principles of the present invention are applicable to many of these, and also to floating structures of other types. All such structures are subject to resonant heave in a seaway.

However, the invention will be better understood from a description of its utility in applicant's platform 10, which is more fully described in said patent No. 4,850,744.

THE PRIOR PLATFORM

Figure 1:
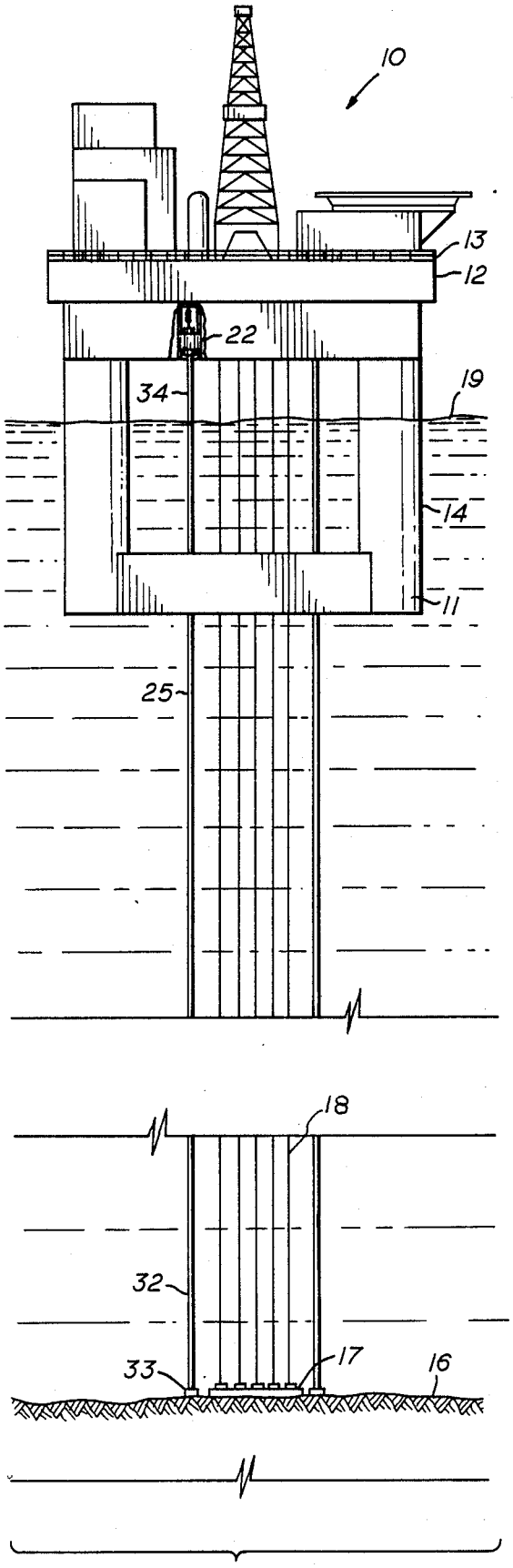
FIG. 1 is a schematic side elevation view illustrating applicants' prior semi-submersible floating production platform in position for production operation over the desired seabed site. The prior production platform is shown to include the anti-heave mechanical braking system of the present invention.

The low-heave, column-stabilized, deep-drafted, floating, production platform 10 (FIG. 1) has a fully-submersible lower hull 11, and an above-water, upper hull 12, which has an upper deck 13. Lower hull 11 together with large cross-section, hollow, buoyant, stabilizing, vertical columns 14 support, at an elevation above the maximum expected wave crests, the entire weight of upper hull 12 and its maximum deck load.

In use, platform 10 is moored onto the desired location 16 by a spread-type mooring system (not shown), which is adapted to resist primarily horizontal motion of the platform.

Platform 10 is especially useful in a design seaway for conducting hydrocarbon production operations in relatively deep waters over a seabed site 16 which contains submerged oil and/or gas producing wells 17. Production risers 18 extend wells 17 to onboard wellheads (not shown) through riser tensioners (not shown). The wellheads are maintained above waterline 19.

THE PRESENT INVENTION

Figure 2:
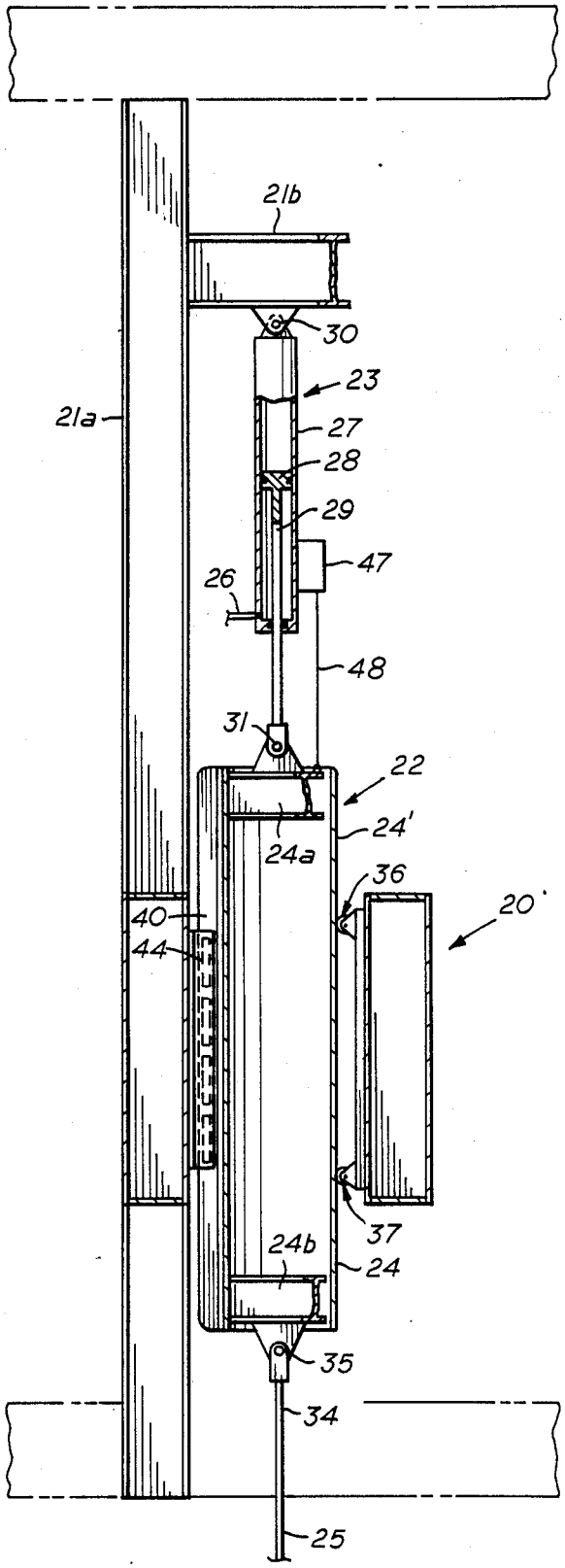
FIG. 2 is a view taken along line 2—2 on FIG. 3.
Figure 3:
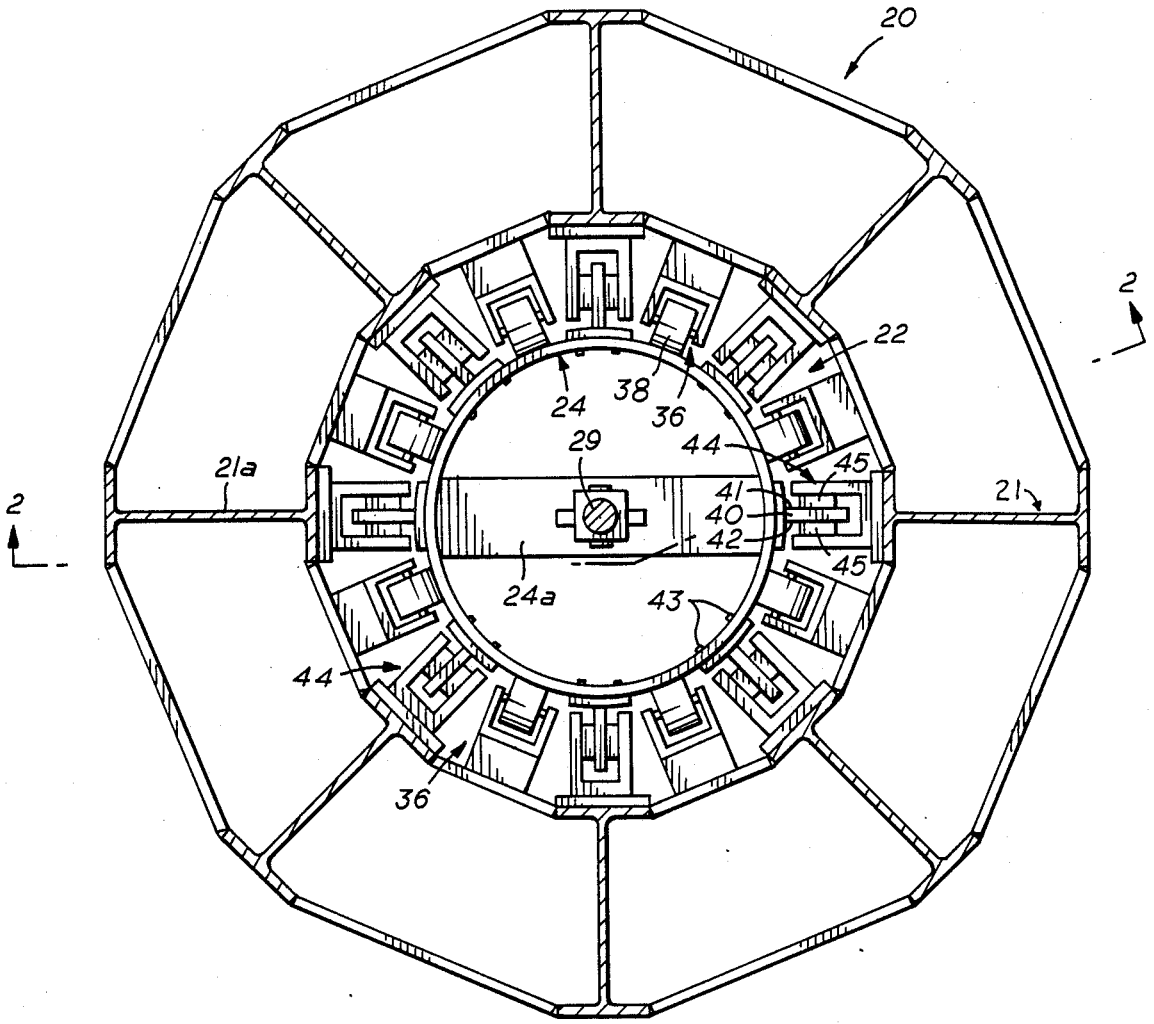
FIG. 3 is a plan view of the framework surrounding the brake cylinder, of the arrays of the linear, hydraulically-activated, friction brakes, and of the centering wheels for the brake cylinder.

In accordance with the present invention, platform 10 provides a very-strong, support framework 20 (FIGS. 2-3) having horizontal and vertical I-beams, all generally designated as 21.

Framework 20 supports a tensioned assembly 22, which in the preferred embodiment includes a tensioner 23, a brake cylinder or drum 24, and a very-long member, which could be a cable, but preferably is a 9⅝"-diameter steel pipe 25, extending down to seabed 16 in several hundred to several thousand feet of water. Brake cylinder 24 has an outer surface 24' and top and bottom braces *24a–24b*.

Pneumatic-hydraulic tensioners are the most commonly used to suspend drilling or production risers, and are well described in U.S. Pat. Nos. 4,733,991, 4,379,657 and 4,215,950.

Each tensioner 23 comprises a pneumatic-hydraulic reservoir (not shown) for supplying through a pipe 26 pressurized hydraulic fluid to a hydraulic cylinder 27 having a power piston 28 and a movable piston rod 29. Pipe 26 connects the bottom of hydraulic reservoir with the bottom of hydraulic cylinder 27 at the rod side thereof.

Hydraulic cylinder 27 is pivotably coupled to a transverse beam 21*b* of framework 20 by a pivot 30. Piston rod 29 extends downwardly and is pivotably connected by a pivot 31 to top brace 24*a*.

Lower end 32 (FIG. 1) of long tensioned pipe 25 is tied to a submerged strong anchor 33 in seabed 16. Its upper end 34 is pivotably attached by a pivot 35 to bottom beam 24*b*.

A top array 36 and a bottom array 37 of centralizing, spring-loaded bearing wheels 38 ride on the outer surface 24' of brake cylinder 24. In this manner, wheels 38 restrict the tendency of brake cylinder 24 to rotate and/or to displace laterally.

Brake cylinder 24 preferably has a circular shape in section and carries fins, generally designated as 40, which extend radially outwardly from cylindrical surface 24' of brake cylinder 24 and are circumferentially spaced apart.

Fins 40 are made of a long, flat metal bar that has a rectangular section defining polished brake surfaces 41, 42 on the opposite sides thereof. Fins 40 are preferably secured by bolts 43 to cylindrical surface 24' of brake cylinder 24 and are therefore replaceable.

Framework 20 carries means for slowing down platform 10, such as arrays of linear, hydraulically-activated, friction caliper brakes 44, which carry friction pads 45 adapted to bear against the opposite, polished surfaces 41, 42 of fins 40.

Mechanical brakes 44 are operated by hydraulic power means (not shown) under the control of an instrumentation control module 47, which is responsive to motion sensors in a line 48 and to load sensors (not shown) on brake pads 45 for the purpose of controlling the brakes 44.

In use, brake cylinder 24 is always maintained suspended above water line 19. The relative motion between platform 10 and tensioned assembly 22 is caused by wave and tidal actions.

Piston 28 has a fixed stroke range calculated to compensate for the maximum expected heave of platform 10 in the design seaway, i.e., the maximum relative vertical displacement between platform 10 and brake cylinder 24. The platform's largest expected heave must be within this stroke range in order to ensure the structural integrity of tensioned assembly 22.

For any position of piston 28 along its stroke, piston-rod 29 will apply a continuous, substantially-constant, predetermined, large, upward-acting force on tensioning assembly 22, regardless of the displacements and velocity of piston-rods 29.

Tensioned assembly 22 is maintained under a large amount of tension, on the order of 100 tons or more for a platform 10 of the type described above, while permitting relative motion between platform 10 and tensioned assembly 22.

It is the object of these frictional forces generated by brakes 44 to prevent excessive platform heave by slowing it down, but preferably only in high waves, i.e., waves which create sufficient buoyant force to overcome the static frictional design force.

Consequently, the particular draft of platform 10 might be deeper than the nominal draft, and a moderate size wave could cause brakes 44 to slip. However, if the platform had already been driven to a higher position (less than nominal draft), a much larger wave would be required to cause brake 44 to slip.

Brakes 44 are deactivated when platform 10 heaves-down, but this energy will be stored as potential energy due to the deeper draft.

The brakes 44 are preset to lock brake cylinder 24 with a static frictional design force. This design force is greater than the tension that will be applied to brake cylinder 24 by the anticipated smaller waves.

However, this design force is less than the tension that will be applied to brake cylinder 24 by the anticipated larger waves.

Accordingly, brakes 44 and fins 40 are designed to be able to first stop the upward displacement of platform 10 in response to these smaller waves.

But, when the upward buoyant forces on platform 10 exceed the design capacity of brakes 44, the brakes will start to slip and at the same time they will slow down the continued upward vertical displacement of platform 10 due to the constant braking forces exerted by brakes 44 against fins 40. When brakes 44 will start to slide relative to fins 40, they will dissipate energy due to the frictional forces (Coulomb friction).

Because brakes 44 apply frictional forces against fins 40 as soon as platform 10 starts to heave up, and then they are deactivated as soon as platform 10 starts to heave down, the platform's down motion will be limited, which will avoid excessive energy dissipation.

When platform 10 is stopped by the brakes, it acts as if it had a taut mooring.

Since the braking forces are derived from mechanical brakes 44, the heave energy pumped into platform 10 by the sea waves is converted only into heat or is stored as potential energy due to draft changes. This heat can be conventionally absorbed by platform 10, by heat exchangers, by circulating sea water through fins 40, etc.

Mechanical brakes 44 develop frictional forces that are independent of the velocity of the platform's displacement. Accordingly, brakes 44 will generate downward-acting anti-heave forces which are substantially constant and also independent of heave velocity of platform 10. The present anti-heave forces will be much larger than prior anti-heave damping forces that are proportional to the heave velocity of platform 10 (Newtonian damping).

It will be apparent that variations are possible without departing from the scope of the invention.

What is claimed is:

1. A structure for floating over a seabed and being subject to resonant oscillatory heave in response to wave action, comprising:

at least one long member extending from said seabed, said long member having a bottom end fixed to said seabed and an upper end suspended from said structure;

first means coupled between said long member and said structure for applying a tension force to said long member;

second means for generating frictional coulomb damping forces on said structure when it moves vertically in an upward direction, thereby preventing excessive platform heave near resonance; and third means for deactivating said second means when said structure heaves down.

2. A floating structure according to claim 1, wherein said second means include fins between the upper end of said long member and said first means, and brakes adapted to press against said fins for dissipating energy due to the heat generated by said frictional forces between said brakes and said fins.

3. A floating structure according to claim 2, and fourth means for restricting said fins from lateral displacements.

4. A floating structure according to claim 2, wherein said brakes are inactive when said floating structure heaves down.

5. A floating structure according to claim 2, wherein said brakes are linear, hydraulically-activated brakes.

6. A floating structure according to claim 2, wherein said second means increase said tension force in said long member only when said floating structure heaves up.

7. A floating structure according to claim 6, wherein said brakes are inactive when said floating structure heaves down.

8. A floating structure according to claim 1, wherein said floating structure is a drilling and/or production platform including production risers, said long member is a pipe, and said first means has a hydraulic cylinder having a reciprocating piston-rod.

9. A floating structure according to claim 8, and fins between the upper end of said long member and said hydraulic cylinder; and said second means include brakes adapted to press against said fins.

10. A floating structure according to claim 9, wherein said brakes are inactive when said floating structure heaves down.

11. A floating structure according to claim 9, wherein said brakes are linear, hydraulically-activated brakes.

12. A floating structure according to claim 11, wherein said brakes increase said tension force in said long member only when said floating structure heaves up.

13. A structure for floating over a seabed and being subject to resonant oscillatory heave in response to wave action, comprising:

at least one long member extending from said seabed, said long member having a bottom end fixed to said seabed and an upper end suspended from said structure;

first means coupled between said long member and said structure for applying a tension force to said long member; and second means for generating frictional coulomb damping forces on said structure only when it moves vertically in an upward direction, thereby increasing said tension in said long member and preventing excessive platform heave near resonance.

14. A floating structure according to claim 13, and third means for deactivating said second means when said structure heaves down.

15. A floating structure according to claim 13, wherein the lower end of said long member is anchored to said seabed.

16. The floating structure according to claim 14, wherein the lower end of said long member is anchored to said seabed.

17. The floating structure according to claim 14, wherein said second means include fins between the upper end of said long member and said first means, and brakes adapted to press against said fins.

18. A structure for floating over a seabed and being subject to resonant oscillatory heave in response to wave action;

at least one long member having a bottom end anchored to said seabed and a top end suspended from said structure;

first means for applying a tension force to said long member;

second means for generating frictional coulomb damping forces when said floating structure heaves up, said frictional forces increasing said tension in said long member;

third means for deactivating said second means when said structure heaves down; and said third means including motion sensing means for activating said brakes when said floating structure heaves up.

* * * * *